US005725045A

United States Patent [19]

Fukihara et al.

[11] Patent Number: 5,725,045

[45] Date of Patent: Mar. 10, 1998

[54] APPARATUS FOR REMOVING SAND ON A DEMOLDED CAST

[75] Inventors: Makoto Fukihara; Toshiki Takamura, both of Toyokawa, Japan

[73] Assignee: Sintokogio, Ltd., Nagoya, Japan

[21] Appl. No.: 671,629

[22] Filed: Jun. 27, 1996

[30] Foreign Application Priority Data

Jun. 30, 1995 [JP] Japan ..... 7-187925

[51] Int. Cl.[6] ..... B22D 29/00; A47L 5/38

[52] U.S. Cl. ..... 164/404; 15/316.1; 15/397

[58] Field of Search ..... 164/404, 131, 164/344; 15/316.1, 397

[56] References Cited

FOREIGN PATENT DOCUMENTS 25388 1/1988 Germany ..... 164/404

58-148073 9/1983 Japan ..... 164/404

1156844 5/1985 U.S.S.R. ..... 164/404

*Primary Examiner*—Joseph J. Hail, III

*Assistant Examiner*—Ing-Hour Lin

*Attorney, Agent, or Firm*—Limbach & Limbach L.L.P.

[57] ABSTRACT

This invention provides an apparatus which can remove sand on a demolded cast product with only an upper cast frame being removed. The apparatus consists of an elevator frame 6 having a ceiling plate 4, a bottom plate 5, and vertical plates 5A, which are movably mounted in the vertical direction on elevator 2, and cylindrical air-ejecting nozzles 9 fitted movably up and down in holes passing through the bottom plate 5.

1 Claim, 2 Drawing Sheets

APPARATUS FOR REMOVING SAND ON A DEMOLDED CAST

BACKGROUND OF THE INVENTION

This invention relates to an apparatus for removing sand on a cast after the removal of an upper frame from the mold wherein the cast has been contained.

In a conventional method of taking out a cast from a mold, to expose the cast, only an upper frame, out of upper and lower frames, is removed, and it is taken out from the mold to be transported for the next process. The residual sand on the cast hinders subsequent treatments such as the removal of a barrage or burr or a grinder finish. Further, the residual sand must be removed since it may produce a cast with an uneven constitution when it is cooled with sand remaining on it.

For the removal of the sand, this method requires extra equipment for reversing or vibrating the cast, and for collecting the removed sand as well. Thus, a large scale of equipment has been needed to remove the sand.

SUMMARY OF THE INVENTION

This invention has been made considering these problems. The object of this invention is to provide an apparatus for removing sand on a cast product with the upper frame of the mold being removed.

The apparatus of this invention for removing sand on a cast product comprises elevator means supported by a stationary frame, an elevator frame mounted on the elevataor means wherein a ceiling plate is connected to a bottom plate having a number of through holes by means of vertical plates so that a vertical interval is provided therebetween, and a number of cylindrical air-electing nozzles, each of which is fitted movably up and down in the through hole, and which comprises a stopping part at its upper end, which part is sized so that it does not go through the aperture of the through hole.

DESCRIPTION OF THE INVENTION

Figure 1:
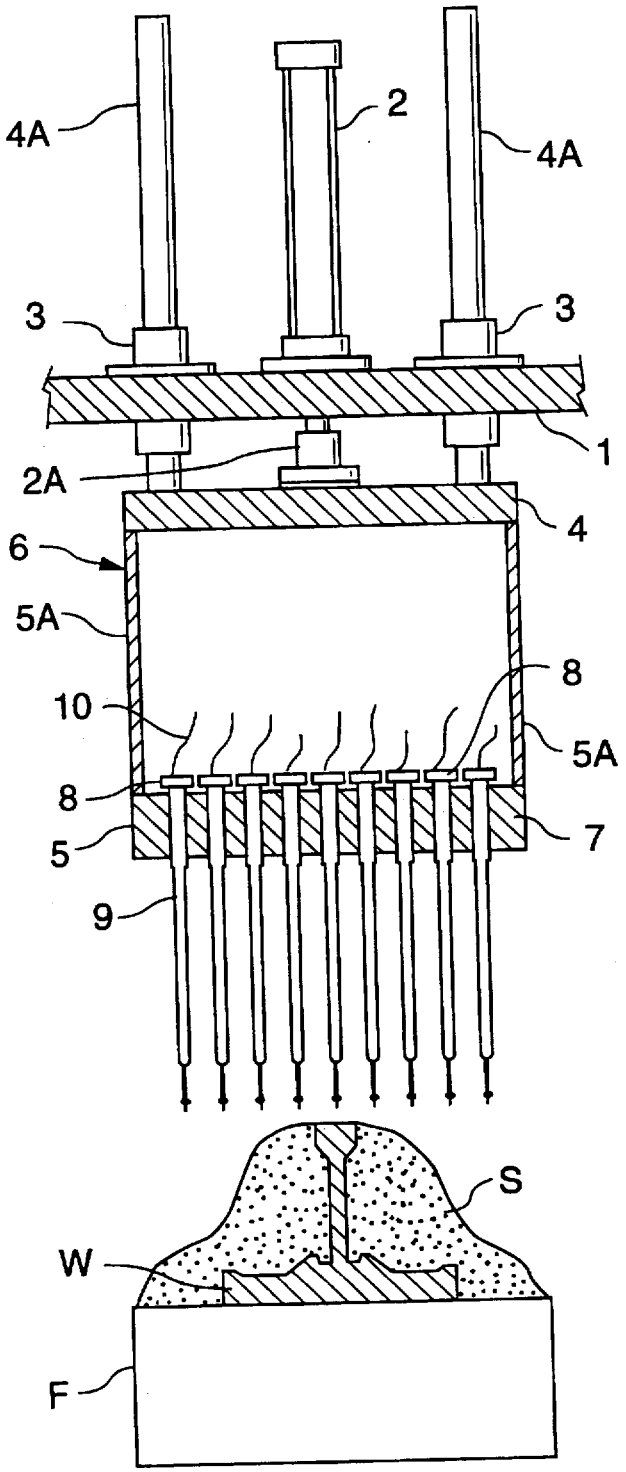
FIG. 1 is a section of an embodiment of the apparatus of this invention, showing a state where the casting sand is about to be removed.

The structure of this invention will now be described by reference to FIG. 1. As elevator means, an air cylinder 2 that faces downwardly is supported by a stationary frame 1 (fixing means not shown), and a pair of guide tubes 3 are fitted in the frame 1 so as to put the air cylinder 2 between them. A frame-shaped elevator frame 6 is mounted movably up and down on the bottom end of a piston rod 2A of the air cylinder 2, which consists of a ceiling plate 4 connected to a bottom plate 5 through a pair of vertical plates 5A so as to provide a given interval therebetween. A pair of guide rods 4A, mounted on the upper part of the ceiling plate 4, are fitted in the guide tubes 3 so as to guide the up-and-down movement of the elevator frame 6.

The bottom plate 5 has a number of through holes 7 vertically passing therethrough. Fitted in the through holes 7 are a number of cylindrical air-ejecting nozzles 9, each with a through hole. 0n each upper end part of the nozzle is formed an enlarged engaging or stopping part 8, which is sized so that it can rest on the upper surface of the bottom plate 5. The stopping part 8 can be a cylindrical flange extending around the nozzle 9, or can take any other form. The nozzle 9 can slidably move up and down in the vertical direction together with the elevator frame 6 while the stopping parts 8 abut the upper surface of the bottom plate 5. The total length of the air-ejecting nozzle 9 is a little less than the interval between the upper and bottom plates 4,5 so that air can be ejected from its bottom tip by connecting the upper end of the nozzle 9 to an air-supply hose connected to an air source (not shown). In FIG. 1, a cast product W covered with casting sand rests on a lower frame F. In this case, the distances between the cast product and the air-ejecting nozzles 9 are measured by distance-measuring means, for example, such as a proximity sensor or pressure sensor, and air may be ejected when the measured distance reaches a given value.

Figure 2:
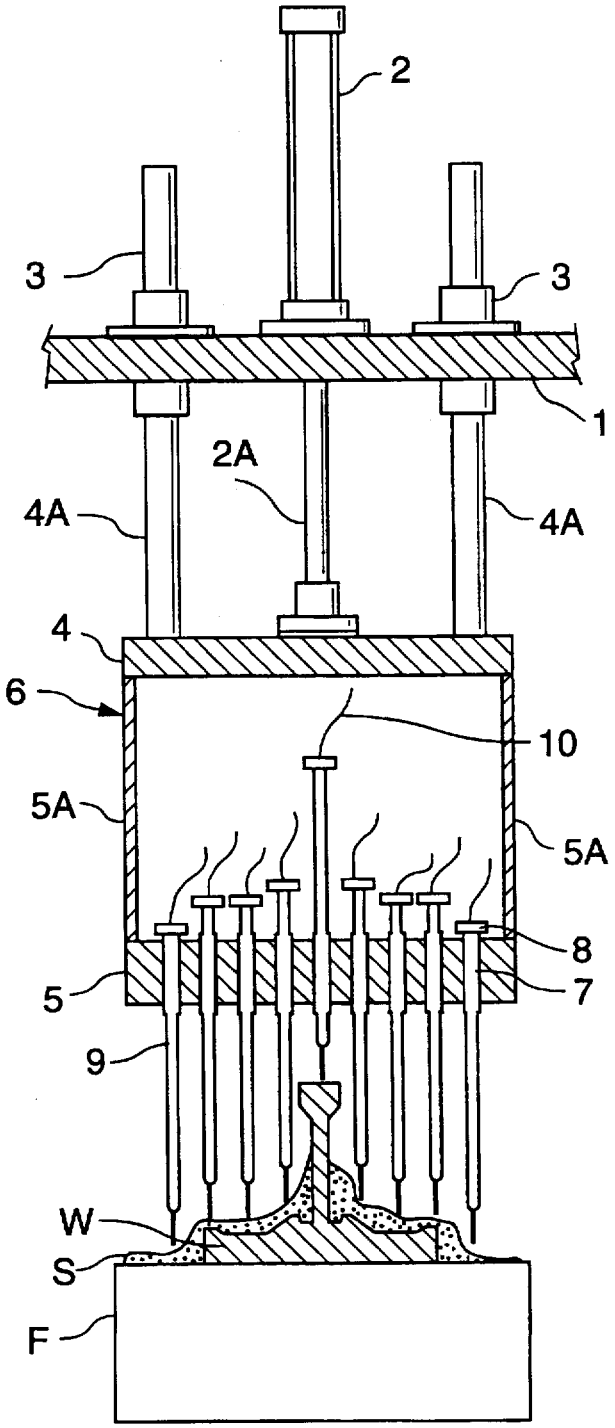
FIG. 2 is a section of the embodiment showing a state where the casting sand is being removed.

To actually remove sand by the above-stated structure a mold containing a cast product W is transported (by means not shown) to a position just under the air-ejecting nozzles 9, and the upper frame is removed (by means not shown) as in FIG. 1. The air cylinder 2 is then driven so that the piston rod 2A goes down, and the elevator frame 6 goes down vertically guided by the guide tubes 3 and guide rods 4A. When the lower end of the air-ejecting nozzle 9, that is positioned at a point corresponding to the highest part of the cast product, goes down to reach there, air is ejected from the lower ends so as to start the operation to remove the casting sand. As the elevator frame 6 goes further down, the air-ejecting nozzle 9, whose lower end has first reached the cast product, is pushed by the cast product at its lower end to slide upwards relative to the other nozzles, while the lower ends of the other air ejecting nozzles 9 sequentially reach the other parts of the cast product so that air is also ejected therefrom to remove the sand (see FIG. 2). At this time the removed sand is blown and falls, and is collected by a sand-collection container, which has been disposed in advance below the cast product, so that the removed sand does not scatter in the factory.

During this time for removing the sand, when the cast product has different heights, the air-ejecting nozzle 9, whose lower end has first reached the cast product, is pushed by the cast product at its lower end to slide upwards relative to the elevator frame 6, and the stopping part 8 nears the lower surface of the ceiling plate 4. However, since the interval between the ceiling plate 4 and bottom plate 5 is set larger than the total length of the nozzle 9, there is no possibility that the stopping part 8 can abut the lower surface of the ceiling plate 4 to prevent the elevator frame 6 from going down except for being prevented from going down by the elevator frame 6 abutting the cast product W.

After the sand S has thus been removed, the air cylinder 2 is reversely driven to shorten the piston rod 2A so that the elevator frame 6 is returned to its original position. In that process the air-ejecting nozzles 9 slide downwards through the through holes 7 by their own weight until the stopping parts 8 abut the upper surface of the bottom plate 5 so that the nozzles 9 are stopped again.

As can be seen from the above-stated description, as this invention can immediately remove sand on a cast product in the position where the upper frame has just been removed, any adverse effect caused by the sand can be avoided in subsequent processes, and the sand can be collected without providing any extra container for the collection.

What is claimed is:

1. An apparatus for removing sand on a demolded cast comprising elevator means supported by a stationary frame disposed above the demolded cast, an elevator frame mounted on the elevator means, the elevator frame 6 being formed such that a ceiling plate is connected to a bottom plate having a number of through holes by means of vertical plates with a given vertical interval provided therebetween, and a number of cylindrical air-ejecting nozzles, each of which is fitted movably up and down in the through hole, and each of which has a stopping part at its upper end, which part is sized so that it can rest on the upper surface of the bottom plate.

* * * * *